United States Patent [19]

Geirhos et al.

[11] 4,422,480

[45] Dec. 27, 1983

[54] LOOM-HEDDLE SELECTOR

[75] Inventors: Werner Geirhos, Senden; Josef Dietmayer, Bibertal, both of Fed. Rep. of Germany

[73] Assignee: Grosse Webereimaschinen GmbH, Neu-Ulm, Fed. Rep. of Germany

[21] Appl. No.: 351,994

[22] Filed: Feb. 24, 1982

Related U.S. Application Data

[63] Continuation-in-part of Ser. No. 153,821, May 27, 1980.

[30] Foreign Application Priority Data

May 31, 1979 [DE] Fed. Rep. of Germany ..... 2922318

[51] Int. Cl.[3] ..... D03C 1/00

[52] U.S. Cl. ..... 139/66 R; 139/76

[58] Field of Search ..... 139/66 R, 74, 76, 77

[56] References Cited

U.S. PATENT DOCUMENTS 3,468,347 9/1969 Fumat ..... 139/66 R 3,804,128 4/1974 Amiques ..... 139/66 R

FOREIGN PATENT DOCUMENTS 1410729 3/1970 Fed. Rep. of Germany ..... 139/76

*Primary Examiner*—Henry Jaudon

*Attorney, Agent, or Firm*—Karl F. Ross

[57] ABSTRACT

An apparatus for operating a loom heddle comprises a drive shaft centered on, rotatable about, and defining an axis, and an eccentric carried on the drive shaft, rotatable relative thereto about the axis, and formed with an axially extending guide. A crank connects the eccentric to the heddle for displacement of the heddle between end heddle positions as the eccentric rotates about the axis. A drive disk rotationally fixed on the drive shaft adjacent the eccentric is formed with at least one recess axially alignable with the guide. An entrainment bolt is axially displaceable in the guide between an extended entrainment position projecting axially in one direction therefrom into the recess of the drive disk and thereby rotationally coupling the drive disk and eccentric together and a retracted position disengaged from the recess for relative rotation of the drive disk and eccentric. A switch element is provided that is operatively engageable with the bolt to displace it axially between the positions.

10 Claims, 8 Drawing Figures

LOOM-HEDDLE SELECTOR

CROSS REFERENCE TO RELATED APPLICATION

This application is a continuation-in-part of copending patent application Ser. No. 153,821 filed May 27, 1980.

FIELD OF THE INVENTION

The present invention relates to an operating mechanism or selector for a loom heddle. More particularly this invention concerns a device which converts a small motion of a heddle-control rod into displacement of the respective heddle at the appropriate time in the weaving cycle.

BACKGROUND OF THE INVENTION

The heddles of a loom must be shifted between the low-shed and high-shed positions at particular times in the loom cycle, normally after the pick is made and the weft is beaten in, to create a standard patterned dobby or jacquard weave. After each pick some of the heddles must be moved from the low-shed to the high-shed position, some in the reverse direction, while others must remain in whichever of the positions they are already in. The selection is made by a reader which generates for each pick an output for each heddle. Each of these outputs is formed by a respective control rod which is movable a very short distance between a position corresponding to the low-shed position and one offset thereform and corresponding to the high-shed position.

Due to the high speed of modern looms it is impossible for the reader to move the heddle control rods at the exact instants when switchover between high- and low-shed positions is possible. Thus displacement of a control rod into the position for a given pick takes place some time during the preceding pick. For example, when a given heddle is in the low-shed position during a pick, its control rod can be displaced by the reader into the high-shed position. Mechanism then switches over the heddle later at the proper instant for the next pick.

It is standard practice to control the heddles by respective eccentric cams carried on a common shaft that rotates continuously or discontinuously. In one angular position of the cam the respective heddle is in the low-shed position and in another angular position, normally offset by 180° from the low-shed position, the heddle is set in the high-shed position, with switchover only possible in these two angularly offset cam positions. This switchover is accomplished by providing between the main drive shaft and each cam a respective latch which can couple and decouple the respective cam from the shaft carrying it. This latch is in turn controlled by the respective control rod. If the heddle is in, say, the low-shed position and for the next pick it is to be in the high-shed position, at the end of the pick its latch will couple it to the shaft. If a heddle is to stay in the same position for the next pick, its latch is left uncoupled.

German patent document 1,410,729 describes such a system wherein a radially displaceable wedge can press latching balls seated in the cam against the drive shaft, thereby coupling the cam to the shaft. Similarly U.S. Pat. 3,468,347 of Fumat shows a system having a latch pawl pivoted for movement about an axis parallel to the drive shaft on the cam, and having a radially displaceable tooth engageable in radially outwardly open notches of the drive shaft. In U.S. Pat. No. 3,804,128 of Amigues another such arrangement is used which has a radially displaceable latch member or cotter which is urged radially inwardly by springs toward a position engaged in a notch of the shaft, but which can be forced radially outardly from this position by a lever operated by the respective control rod.

These systems all have the considerable disadvantage that the latching mechanisms do not work well at high speed. The main problem is that the high centrifugal forces brought into play at high speed occasionally inhibit the desired motion of the latch mechanisms, which all rely on radially dispaceable elements. Thus if a given part is to be moved radially inwardly, at high speed it must be moved against considerably outwardly effective centrifugal force. Indeed in very high-speed operations some of the latch members can even be thrown centrifugally into the outer positions to put the respective heddles in the wrong position and ruin the goods being produced.

OBJECTS OF THE INVENTION

It is therefore an object of the present invention to provide an improved heddle-operating selector mechanism.

Another object is the provision of such a heddle-operating mechanism which overcomes the above-given disadvantages.

Yet another object is the provision of a heddle selector or operator operates as well at high speeds as at low speeds.

SUMMARY OF THE INVENTION

These objects are attained according to the instant invention in an apparatus for operating a loom heddle which comprises a drive shaft centered on and defining an axis, means for rotating the drive shaft about the axis, and an eccentric carried on the drive shaft, rotatable relative thereto about the axis, and formed with an axially extending guide. Crank means connects the eccentric to the heddle for displacement of the heddle between end heddle positions as the eccentric rotates about the axis. A drive disk rotationally fixed on the drive shaft adjacent the eccentric is formed with at least one recess axially alignable with the guide. An entrainment bolt is axially displaceable in the guide between an extended entrainment position projecting axially in one direction therefrom into the recess of the drive disk and thereby rotationally coupling the drive disk and eccentric together and a retracted position disengaged from the recess for relative rotation of the drive disk and eccentric. Means is provided including a switch element operatively engageable with the bolt to displace same axially between the positions.

Thus with the system of this invention the latch element—the bolt—and the part operating it—the switch element—move wholly axially. These parts will therefore be almost wholly unaffected by centrifugal force. Hence the rotary latch between the eccentric and the drive disk will operate well at high speeds. In addition such bolt-type latching has the advantage of great simplicity so that it can be produced cheaply and can be counted on to have a long service life with few breakdowns.

According to another feature of this invention the bolt is formed with a radially open notch. The switch element engages in this notch and, as mentioned above, moves wholly axially. In fact the switch element is rockable on the eccentric about an axis generally perpendicular to the plane of the guide and of the shaft axis. Biasing means, normally in the form of one or more compression springs, urges the bolt continuously into the entrainment position. The mechamism that does the critical job of latching the eccentric and drive disk together therefore is mechanically simple.

Since it is standard practice for the heddle positions to be associated with 180° offset positions of the drive shaft, the drive disk is formed with two such recesses diametrically offset from each other and radially equispaced from the axis. Thus position change can take place each time the drive shaft rotates through 180°.

In order to lock the loom heddle in its positions, the apparatus of this invention further comprises means forming an axially open seat substantially angularly fixed relative to the axis and axially alignable with the guide and recess. The bolt is engaged in the seat in the retracted position. Thus in this retracted position the eccentric is rotationally arrested.

According to this invention the bolt cannot simultaneously assume both of its positions, which would result in locking of the eccentric and drive disk to the fixed seat. Thus when the seat, guide, and recess are axially aligned the axial distance between the drive disk and the crank immediately adjacent the seat and recess is less than the axial length of the bolt.

The crank means includes a crank formed with two such seats diametrically offset from each other and radially equispaced from the axis. This crank is movable substantially only radially perpendicular to the plane of the seats. In addition the switch element has a pair of parts axially aligned with the seats, linked together for joint pivoting about an axis crossing and generally perpendicular to the main shaft axis, and operatively engageable with the bolt when same is aligned axially with the respective seats. To this end the switch element can be formed as a large fork having two tines or fingers constituting these parts. This type of construction allows the entire assembly to be axially relatively shallow.

DESCRIPTION OF THE DRAWING

The above and other features and advantages will become more readily apparent from the following, reference being made to the accompanying drawing in which.

SPECIFIC DESCRIPTION

Figure 1:
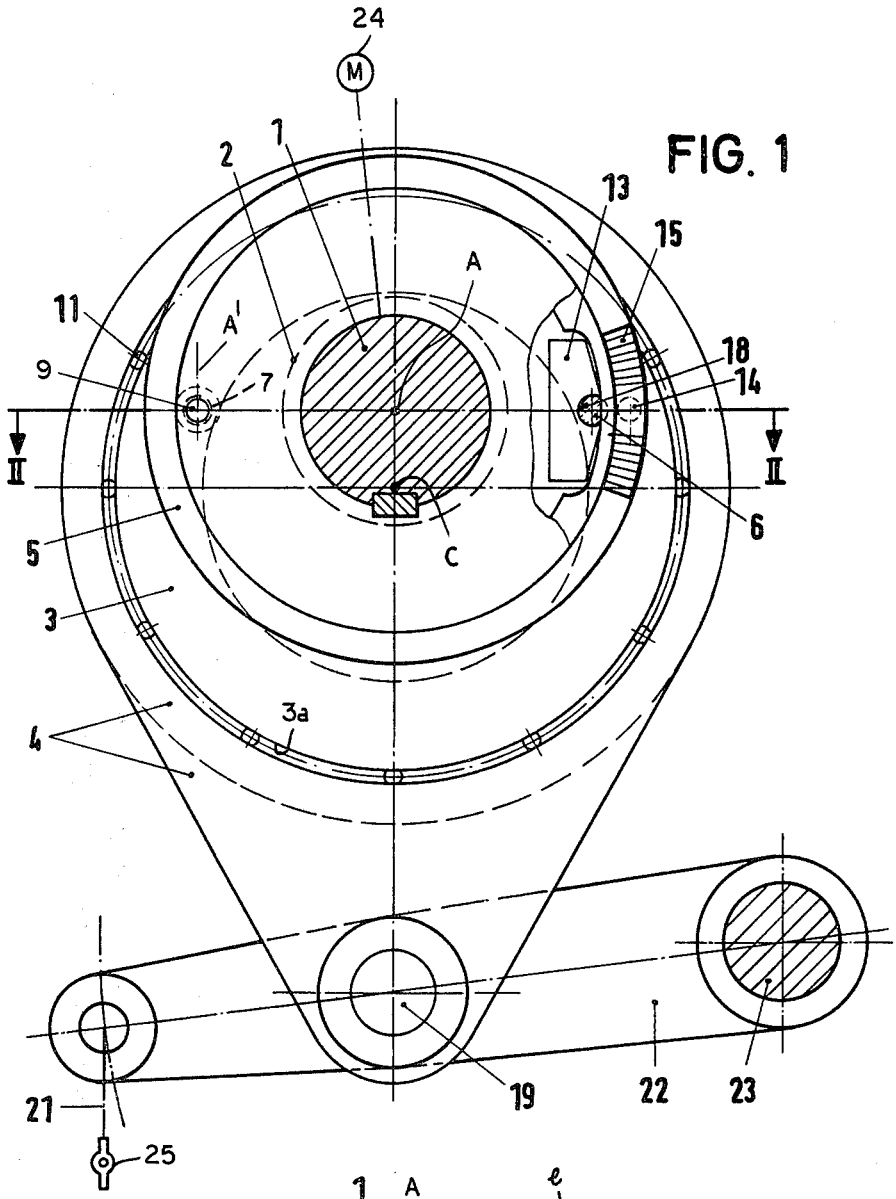
FIG. 1 is a cross-sectional view partly in schematic form and partly broken away showing the apparatus of the instant invention.
Figure 2:
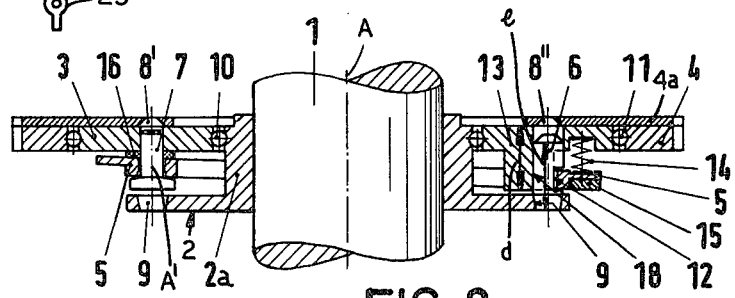
FIG. 2 is an axial section taken along line II—II of FIG. 1.

As seen in FIGS. 1 and 2 a loom according to this invention has a main drive shaft 1 extending along a main axis A and rotatable thereabout either continuously or discontinuously by a motor 24. This loom further has a multiplicity of heddles 25 movable between low-shed and high-shed positions by respective rods 21 pivoted on respective operating levers 22 in turn pivoted on a common axially extending rod 23 on the loom frame.

Associated with each heddle 25 is a respective entrainment or drive disk 2 keyed to the shaft 1 for joint rotation therewith. This disk 2 has a hub **2*a* on which a plurality of rollers 10 support an eccentric cam or disk 3 having a circular periphery 3*a* with a center C that is offset by a distance E from the axis A. Another plurality of rollers 11 support a crank plate 4 on this periphery 3*a*. In turn this crank plate 4 is pivoted at 19 on the respective lever 22**.

Thus if the eccentric disk 3 is fixed to the drive disk 2, as the shaft 1 rotates along with the disks 2 and 3 the pivot 19 will move radially of the axis A through a distance equal to 2E. This stroke corresponds to the stroke necessary to move the lever 22 and heddle 25 from the low-shed position of FIGS. 1 and 6 to the high-shed position of FIG. 3.

The disk 4 is provided on its face turned away from the disk 2, as seen in FIG. 2, with a thin plate **4*a* formed relative to the axis A at diametrically opposite locations with throughgoing holes or seats 8' and 8'' which, it is important to note, can be considered to be angularly fixed with respect to the axis A. This plate 4*a* lies flatly against the face of the disk 3 and, along with the balls 11, serves to carry the plate 4 on the disk 3** while permitting it to rotate relative thereto.

The eccentric disk 3 has a thickened region or portion 13 formed with an axially extending guide bore 18 axially alignable with the holes 8' and 8'' and axially slidably receiving an entrainment bolt 6. In addition the drive disk 2 is formed with throughgoing holes or seats 9 at diametrically opposite locations alignable with the holes 8' and 8'' and bolt 6. The slidable bolt 6 has an axial length L which is greater than the axial distance d between the plate **4*a* and the disk 2 by an amount equal approximately to the axial thickness of the plate 4*a*. Thus the bolt 6 can either be engaged in one of the seats 8' or 8'', in which case the eccentric disk 3 is rotationally coupled to the nonrotatable plate 4, or in one of the seats 9, in which case the eccentric disk 3 is rotationally coupled to the rotatable drive disk 2. It cannot engage simultaneously in one of the holes 8' or 8'' and one of the holes 9**.

Diametrically opposite the guide 18 the eccentric disk 3 is provided with an axially extending pivot pin 7 on which a switching plate or disk 5 is loosely mounted, with interposition of a soft washer 16. This plate 5 can therefore rock about an axis A' which is offset from the axis A and which lies in a plane perpendicular to this axis A. The end of the disk or plate 5 diametrically opposite the pin 7 engages in a radially outwardly open notch 12 formed in the bolt 6. It would also, of course, be possible to provide radial projections on the bolt 6 that engage this part of the plate 5, but either way what is important is that at this location the plate 5 and bolt 6 are coupled together for joint axial displacement. One or more compression springs 14 are braced axially between the eccentric 3 and the switch plate 5 adjacent the bolt 6. The spring 14 therefore urges the bolt 6 into a position engaged in one of the holes 9 and coupling the disks 2 and 3.

A switching element or fork 17 displaceable on a rod 20 about an axis A″ prependicular to the axis A has a pair of fingers 26′ and 26″ that are positioned at diametrically opposite locations on the plate 5, in radial line with the holes 8′ and 8″ of the plate 4*a*. These fingers 26′ and 26″ can engage axially against a cam part 15 of the plate to displace it against the force of the spring 14 and thereby push the bolt 6 into either of the holes 8′ or 8″.

Figure 3:
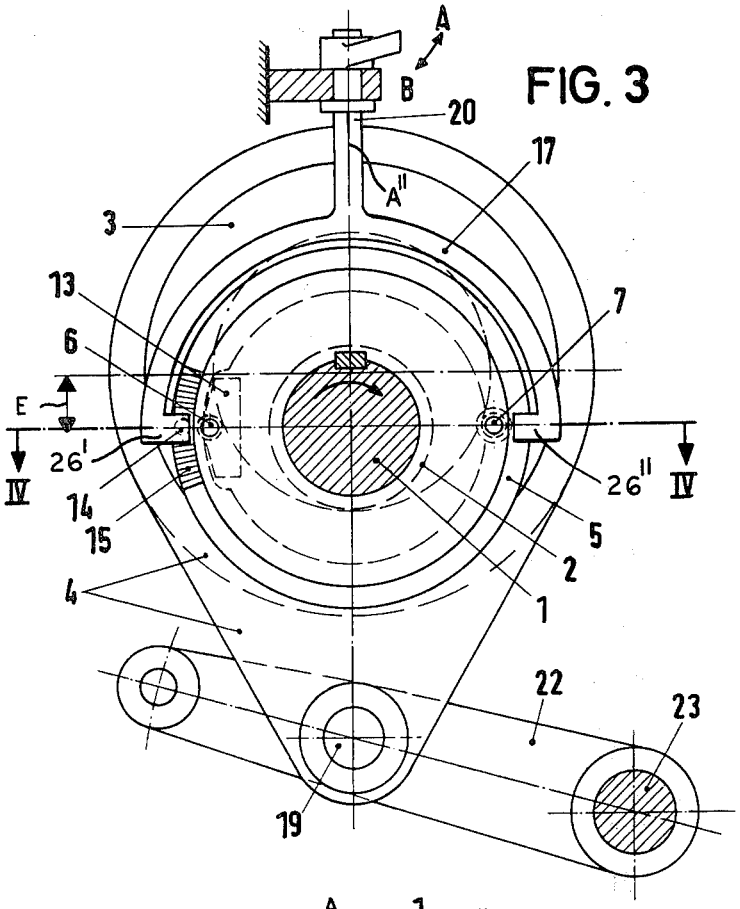
FIG. 3 is an end view of the apparatus in the high-shed position.
Figure 4:
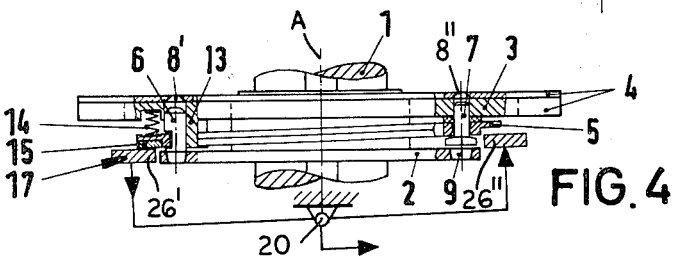
FIG. 4 is a section taken along line IV—IV of FIG. 3 with the low-shed position selected.

Thus when the mechanism is in the high-shed position shown in FIG. 3 it is possible for the fork 17 to switch it to the low-shed position by pivoting about its axis A″ so that as shown in FIG. 4 its finger 26′ engaged with the cam part 15 pulls axially away from the plate 4, thereby allowing the spring 14 to push the bolt 6 out of the high-shed anchor hole 8′ and into the next hole 9 that comes into axial alignment with this bolt 6, without the bolt 6 being able to pull out of the hole 8′ until it can move into a hole 9. This rotationally links the plates 2 and 3 until they move through 180° to the low-shed position, when the other finger 26″ will push the bolt 6 back toward the plate 4 to engage it in the low-shed anchor hole 8″, thereby arresting the eccentric disk 3 again. The drive disk 2 can continue to rotate in the same direction, stop and continue in the same direction, or stop and reverse in this position without moving the eccentric disk 3.

Figure 5:
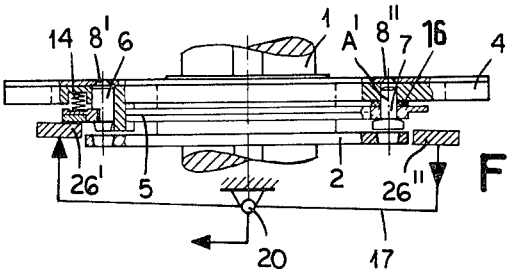
FIG. 5 is a view like FIG. 4 but showing the high-shed position selected.

The high-shed position of FIG. 3 can be maintained simply by holding the fork 17 relative to its axis A″ in the angular end position shown in FIG. 5. In this position the one finger 26′ holds the bolt 6 in the high-shed anchor hole 8′, thereby linking the eccentric disk 3 with the nonrotating crank plate 4. In this position, once again, the drive disk 2 moves completely independently of the eccentric disk 3.

Figure 6:
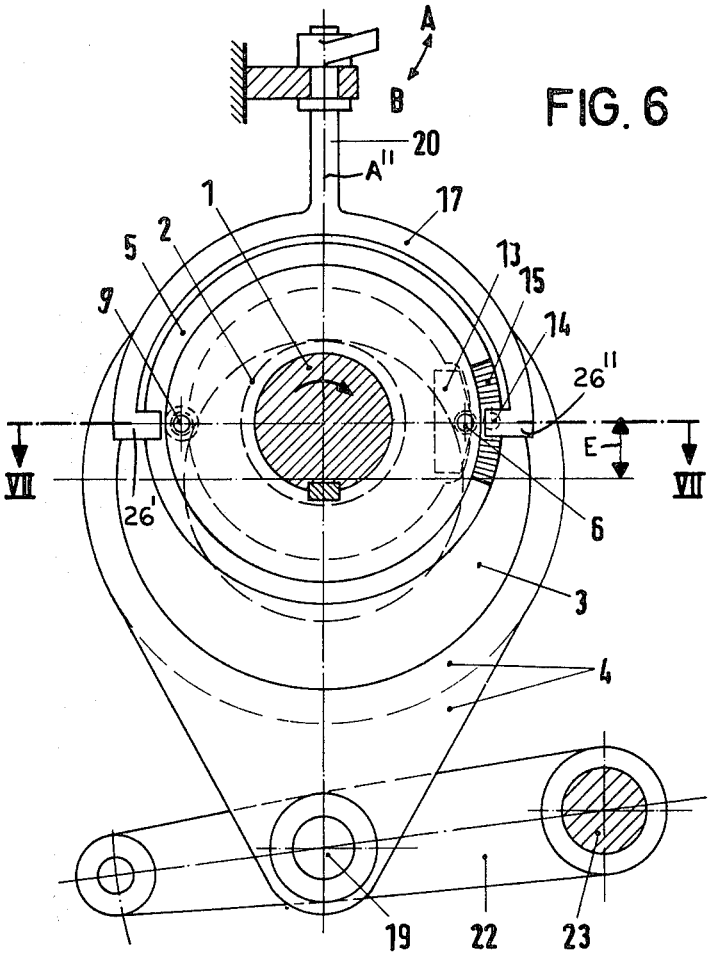
FIG. 6 is an end view of the apparatus in the low-shed position.
Figure 7:
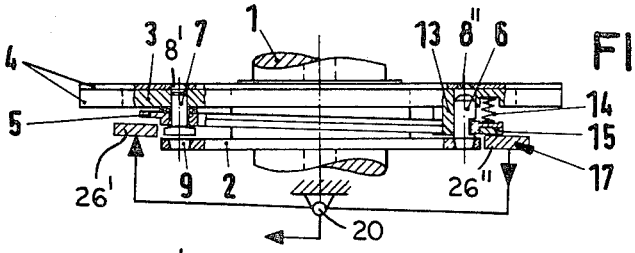
FIG. 7 is a section taken along line VII—VII of FIG. 6 with the high-shed position selected.

Similarly if the apparatus is in the low-shed position of FIG. 6, which it could reach from the high-shed position by displacement of the fork 17 from the position of FIG. 5 to that of FIG. 4, it could be switched to the high-shed position by pivoting of the fork 17 about the axis A″ as shown in FIG. 7. This would allow the spring 14 to disengage the bolt 6 as in FIG. from the low-shed anchor hole 8″ to rotationally link the plates 2 and 3 until they move through 180° to the high-shed position, when the other finger 26′ will push the bolt 6 back toward the plate 4 to engage it in the high-shed anchor hole 8′, thereby arresting the eccentric disk 3 again.

Figure 8:
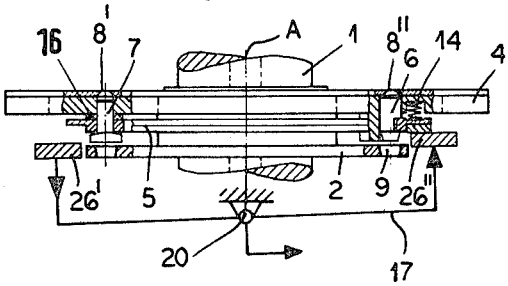
FIG. 8 is a view like FIG. 7 but showing the low-shed position selected.

The device can be maintained in the FIG. 6 low-shed position simply by holding the switch fork 17 in the position of FIG. 8. The finger 26″ retains the bolt 6 in the low-shed anchor hole 8″ while the drive disk 2 rotates without touching or moving any of these parts.

The arrangement according to this invention therefore positively retains the cam disk 3 in either of its positions. If at any time during a given cycle, which starts just as a hole 9 moves past the bolt 6, a change in shed position is set in the fork 17, this change will not be effected until the next hole 9 aligns itself with the bolt 6, which will occur after the drive disk 2 has rotated through 180°. Once the drive disk 2 is at the extreme end of its cycle, the bolt 6 will switch axially over and move the eccentric disk 3 through 180°, then stop. In this manner the heddle position for the next pick can be set in the mechanism at any time during the preceding pick, so that the reading mechanism need not produce its output at a closely defined point in time, but instead has a relatively wide time slot during which it can set the next heddle position.

The only moving parts of the rotary latch, which is formed mainly by the bolt 6 and the switch element 5, move wholly axially between their end positions. Centrifugal force has therefore virtually no effect on the operation of this latch, so that the device can be counted on to operate well even at very high rotary speeds. What is more, these latch parts are mounted on the disk 3 which only rotates between picks. Since it is normal in most specialty weaves for a given heddle to stay in one up or down, that is high-shed or low-shed, position for several picks in a row, this means that these moving parts are subjected to minimal movement. Hence the service life of the system of this invention is quite long. It is also possible for this system to be made axially quite short, so that it can easily be incorporated in a large loom. The flat switch fork need only oscillate through a few degrees about its axis A″ to move the bolt 6 from the low-shed to the high-shed position, so that the entire assembly is quite compact.

We claim:

1. An apparatus for operating a loom heddle, said apparatus comprising:

a drive shaft centered on and defining an axis;

means for rotating said drive shaft about said axis;

an eccentric carried on said drive shaft, rotatable relative thereto about said axis, and formed with an axially extending guide;

crank means connecting said eccentric to said heddle for displacement of said heddle between end heddle positions as said eccentric rotates about said axis;

a drive disk rotationally fixed on said drive shaft adjacent said eccentric and formed with at least one recess axially alignable with said guide;

an entrainment bolt axially displaceable in said guide between an extended entrainment position projecting axially in one direction therefrom into said recess of said drive disk and thereby rotationally coupling said drive disk and eccentric together and a retracted position disengaged from said recess for relative rotation of said drive disk and eccentric; and means including a switch element operatively engageable with said bolt to displace same axially between said positions.

2. The apparatus defined in claim 1 wherein said bolt is formed with a radially open notch, said switch element engaging in said notch.

3. The apparatus defined in claim 2 wherein said switch element is rockable on said eccentric about an axis generally perpendicular to the plane of said guide and of the shaft axis.

4. The apparatus defined in claim 1, further comprising biasing means for urging said bolt into said entrainment position.

5. The apparatus defined in claim 4 wherein said switch element is axially displaceable with said bolt, said biasing means including at least one spring adjacent said bolt and braced axially between said eccentric and said switch element.

6. The apparatus defined in claim 1 wherein said drive disk is formed with two such recesses diametrically offset from each other and radially equispaced from said axis.

7. The apparatus defined in claim 1, further comprising means forming an axially open seat substantially angularly fixed relative to said axis and axially alignable with said guide and recess, said bolt being engaged in said seat in said retracted position, whereby in said retracted position said eccentric is rotationally arrested.

8. The apparatus defined in claim 7 wherein when said seat, guide, and recess are axially aligned the axial distance between said drive disk and said crank immediately adjacent said seat and recess is less than the axial length of said bolt.

9. The apparatus defined in claim 7 wherein said crank means includes a crank formed with two such seats diametrically offset from each other and radially equispaced from said axis, said crank being movable substantially only radially perpendicular to the plane of said seats.

10. The apparatus defined in claim 9 wherein said switch element has a pair of parts axially aligned with said seats, linked together for joint pivoting about an axis crossing and generally perpendicular to the main shaft axis, and operatively engageable with said bolt when same is aligned axially with the respective seats.

* * * * *